United States Patent [19]

Schmidt et al.

[11] Patent Number: 4,542,264

[45] Date of Patent: Sep. 17, 1985

[54] LEAD-FRAME FOR AN ELECTRIC MICROPHONE

[75] Inventors: Henning M. Schmidt, Tyresö; Hans G. Malmkvist, Enskede; Arvi J. Aksberg, Lidingö; Jan H. Johansson, Bålsta, all of Sweden

[73] Assignee: Telefonaktiebolaget LM Ericsson, Stockholm, Sweden

[21] Appl. No.: 499,149

[22] PCT Filed: Oct. 6, 1982

[86] PCT No.: PCT/SE82/00318

§ 371 Date: May 19, 1983

§ 102(e) Date: May 19, 1983

[87] PCT Pub. No.: WO83/01362

PCT Pub. Date: Apr. 14, 1983

[30] Foreign Application Priority Data

Oct. 7, 1981 [SE] Sweden ..... 8105913

[51] Int. Cl.[4] ..... H04R 19/01

[52] U.S. Cl. ..... 179/111 E; 29/592 E

[58] Field of Search ..... 179/111 E, 111 R; 381/113; 367/170; 307/400; 357/70; 361/421

[56] References Cited

U.S. PATENT DOCUMENTS

| | | | |
|---|---|---|---|
| 2,478,469 | 8/1949 | Earle | 361/421 |
| 3,317,671 | 5/1967 | Mitchell et al. | 179/107 R |
| 3,328,653 | 6/1967 | Wolf | 179/111 R |
| 4,017,768 | 4/1977 | Valfre | 361/421 |
| 4,017,770 | 4/1977 | Valfre | 361/421 |
| 4,031,272 | 6/1977 | Khanna | 338/308 |
| 4,059,810 | 11/1977 | Paletto | 357/70 |
| 4,169,271 | 9/1979 | Saitoh | 357/70 |
| 4,188,513 | 2/1980 | Morrell et al. | 179/111 E |
| 4,320,412 | 3/1982 | Hynes et al. | 357/70 |
| 4,385,209 | 5/1983 | Greason et al. | 179/111 E |
| 4,492,825 | 1/1985 | Brzezinski et al. | 179/111 R |

FOREIGN PATENT DOCUMENTS

| | | | |
|---|---|---|---|
| 2064264 | 6/1981 | United Kingdom | 381/113 |

OTHER PUBLICATIONS

Elektor, "Electret Microphone Preamplifier", vol. 3, No. 12, Dec. 1977, pp. 12-18-12-19.

*Primary Examiner*—Gene Z. Rubinson
*Assistant Examiner*—Danita R. Byrd
*Attorney, Agent, or Firm*—Roberts, Spiecens & Cohen

[57] ABSTRACT

A lead frame for an electric microphone which includes an H-shaped structure of thin metallic material including spaced parallel legs and a crossbar therebetween. A first plate is spaced from the crossbar and is located between the legs. A lead connects the first plate to the crossbar. A second plate is spaced from the first plate and is connected thereto by a lead. All of the above structure is monolithic and coplanar being formed of a thin metallic material. The second plate is provided with holes and a amplifier chip is mounted on the first plate. Leads are provided connecting the chip with the aforesaid legs. The above structure is entrapped between two case halves and a metallized film is supported between the halves and in spaced parallel relationship with the second plate being supported on distant pieces. A cover encircles the case halves.

12 Claims, 4 Drawing Figures

LEAD-FRAME FOR AN ELECTRIC MICROPHONE

FIELD OF INVENTION

The present invention relates to a lead-frame for an electret microphone and associated preamplifier of integrated design.

BACKGROUND ART

As known, an electret microphone consists of a charged and/or polarized polymer film, called an electret film, one surface of which is coated with a thin metal layer which constitutes one of the electrodes in the microphone. The electret film and the metallized electrode are biased having the metallized layer turned upwards along a rear plate which constitutes the second electrode. Between the electret film and the rear plate or the rear electrode a small air gap, called an air film, is formed and an electrostatic field between the two electrodes is created. This field is called a bias field. Upon acoustic influence by sound pressure in front of the microphone, the electret film vibrates and the height of the air gap is changed, whereby the electrostatic field is changed. Due to this variation of the electrostatic field, a varying voltage drop across the two electrodes arises. Thus, if an amplifier having a suitable impedance match is connected between the two electrodes a voltage change depending on the variable sound pressure on the electret film can be obtained.

Since the voltage variation across the two electrodes is weak, it is, as above mentioned, necessary to connect an amplifier with a suitable impedance match to the electrodes. The problem is then to limit the number of parts in the microphone and at the same time to have a good connection between electret and amplifier.

It is previously known for this purpose to build in the electret microphone an integrated circuit containing a preamplifier and to form the same into a single capsule as shown, for example, in the Bell System Technical Journal, September 1979, No. 7, page 1557. Thereby a compact unit is obtained.

SUMMARY OF INVENTION

An object of the present invention is to reduce the number of units in an electret microphone by providing a lead-frame for the electret film and the associated preamplifier, thus provides a compact and simple construction for a microphone-preamplifier unit.

The invention is characterized by the provision of a lead frame for an electret microphone. The lead frame of the invention comprises an H-shaped structure of thin metallic material including spaced parallel legs and a crossbar therebetween. A first plate spaced from the crossbar is located between the aforesaid legs. A lead connects the first plate to the crossbar. A second plate is spaced from the first plate and a lead connects the two said plates. The plates and the leads are monolithic with and coplanar with the H-shaped structure being formed of metallized film. The second plate is provided with holes and an amplifier chip is mounted on the first plate. Leads connect the chip with the aforesaid legs. A first case half supports the aforesaid plates with distant pieces being provided adjacent the second plate and a metalized film being supported on the distant pieces in spaced parallel relation to the second plate. A second case half is superposed on the first case half and is provided with openings corresponding with the aforesaid plate. A cover encircles the two said halves.

BRIEF DESCRIPTION OF THE DRAWINGS

The invention will be more fully described with reference to the accompanying drawings in which.

DETAILED DESCRIPTION OF THE INVENTION

Figure 1:
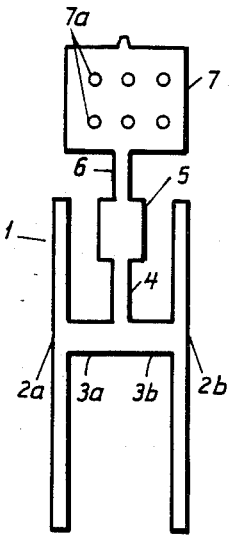
FIG. 1 shows a lead-frame according to the invention.

In FIG. 1, the lead-frame according to the invention is generally designated 1. It consists of a thin metallic material such as, for example, nickel, brass or copper. In the illustrated embodiment, one part of the frame consists of two leads 2*a*,2*b* which have approximately the same width and extend in parallel. After manufacturing they are kept together by means of two connecting parts 3*a*,3*b* in an H-shaped structure wherein the leads 2*a*, 2*b* are parallel legs and the connecting parts are the crossbar or only 3*b*. The upper part of a lead 4 is terminated by a broader part or plate 5 which ends in a further plate 7 through a connecting part 6. The latter plate 7, according to the invention, forms the rear electrode in the complete electret microphone. The plate 5 is intended as a base plate for the integrated preamplifier. The electrode plate 7 and the plate 5 together with the connecting part 6 form the second part of the lead-frame. The leads 2*a*,2*b* protrude somewhat beyond the parts 3*a*,3*b* and are ended approximately on a level with the plate 5, in order to make a contact spot for the amplifier which is mounted on the plate 5. Possibly the connecting parts 3*a*,3*b* are not necessary if the leads 2*a*,2*b* are kept together by means of carrying band 22*b* according to FIG. 4 before connection to the amplifier chip on the plate 5. The part 6 forms conductive connection between the preamplifier and the plate 7 serving as rear electrode in the mounted electret microphone. The plate 7 is suitably provided with small, suitably circular holes 7*a* to equalize the pressure so that the air between the plate and the electret film in the mounted microphone can freely pulsate in time with the vibrations of the film.

Figure 2:
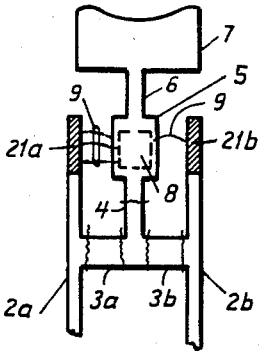
FIG. 2 shows a part of a lead-frame according to FIG. 1 for mounting a monolite circuit.

FIG. 2 shows in a simplified manner how the mounting of the amplifier chip 8 onto the plate 5 is carried out. The chip 8 containing an amplifying circuit is glued onto the plate 5. Furthermore the uppermost placed portions of the leads 2*a*,2*b* are provided with a surface of, for example, gold. Gold or Al wires 9 are bonded to the amplifying circuit in the chip 8 and connected to the surfaces 21*a*, 21*b* on the leads 2*a*,2*b*. After mounting, the parts 21*a*, 21*b*,5,8 and parts of the leads 4 and 6 are enclosed in a capsule, for example, by means of plastic moulding in a manner known per se. When this has been carried out, the connecting parts 3*a* and 3*b* (if they exist) can be cut away as has been indicated in FIG. 2. The two plates 5 and 7 do not necessarily have to be conductively connected through a part 6 integrated with the lead frame as shown in FIGS. 1 and 2. The conducting connection can also be achieved, for example, by spot welding a separately manufactured rear electrode plate with the plate 5, which carries the amplifier. As an alternative, the output of the amplifier to the rear electrode can be welded together with this electrode.

Figure 3:
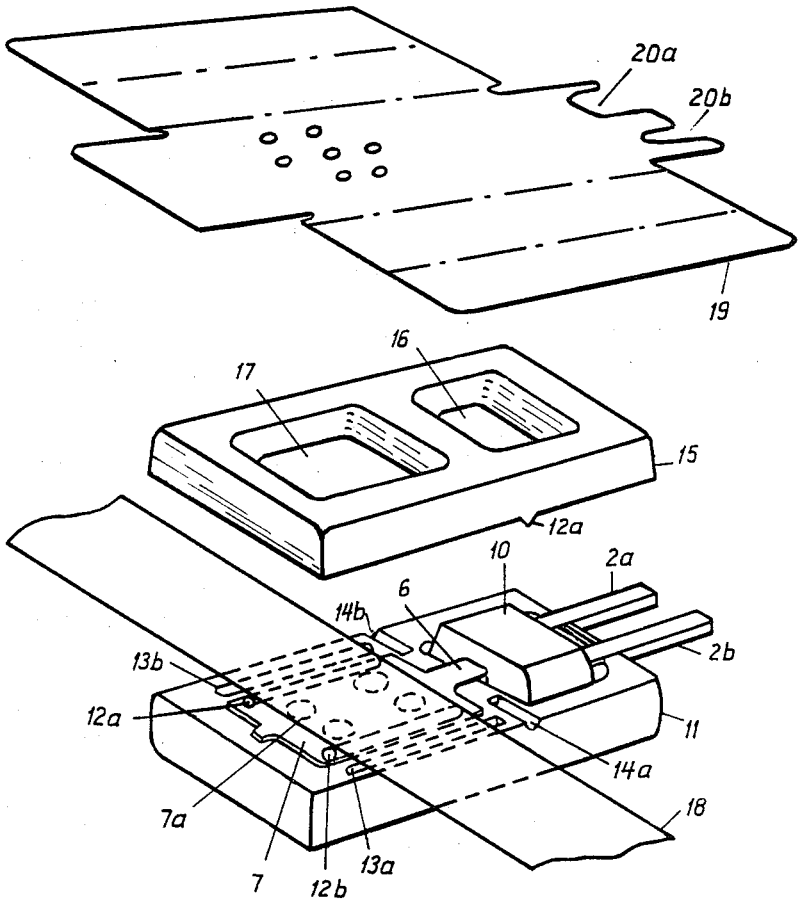
FIG. 3 is an exploded view of an electret microphone and an amplifier capsule utilizing the lead-frame according to the invention, an FIG. 4 shows a carrier band with a number of frames according to the invention.

FIG. 3 shows how the mounting of the electret and the amplifier is carried out. The plate 7 serving as the rear electrode together with the mounted capsule 10 containing the amplifier is placed in a lower case half 11. This half is provided with recessions corresponding to the capsule 10, the lead 6 and the plate 7. Along two side edges of the plate 7, two longitudinal distance pieces or bars 12*a*, 12*b* are provided, for example, by means of hobbing. Furthermore recessions 13*a*,13*b* and 14*a*,14*b* are formed in the upper surface of the lower case half.

An upper case half 15 is provided with two openings 16 and 17, the opening 17 being a sound opening opening 16 helps to support the capsule 10. Furthermore a guide 12*a* is shaped on the lower surface of case half 15 to be fit into the recession 14*a* in the lower case half 11. Similar projections for the recessions 13*a*,13*b* and 14*b* are shaped on the underside of the case half 15, but are not shown in FIG. 2.

An electret film in the shape of a strip 18 is placed on the two longitudinal distance pieces 12*a*, 12*b* and the upper case half 15 is put in place over the lower case 11. The electret film is oriented with the metallized surface towards the lower surface 15. The electret film is then squeezed into the recessions 13*a*,13*b* by the corresponding guides (not shown). After that, a cover 19 is placed over the upper case half 15 and is folded around the two mounted halves 11, 15, the squeezing force on the electret film being maintained. Before this, the film 18 is cut to such a length as to have a piece outside the case parts 11, 15 so that contact between the metallized surface on the film 18 and the cover 19 is obtained when the cover is folded around the parts 11, 15. The cuts 20*a*, 20*b* in the cover 19 will then partly surround the leads 2*a*,2*b*. In FIG. 3, the cut 20*b* has a somewhat smaller dimension than the cut 20*a* to make contact between the lead 2*b* and the cover 19. In this manner the lead 2*b* and the metallized surface of the electret film will have the same potential which constitutes the reference potential for the electret microphone.

In FIG. 1, the lead frame is shown with four leads. Of course it is possible to form the frame 1 so that more leads than those shown at 2*a*,2*b*,4 and 6 are obtained, for example to create a connection to amplifier adjusting circuits or the like.

Suitably the electret film is made of Teflon and the two case halves are, for example, of ABS-plastics. The material of the case halves should have the same magnitude of thermal coefficient of expansion as the electret film. This implies that upon a temperature change, no change of the tension force on the electret film arises as such change could otherwise cause changed resonance conditions.

Figure 4:
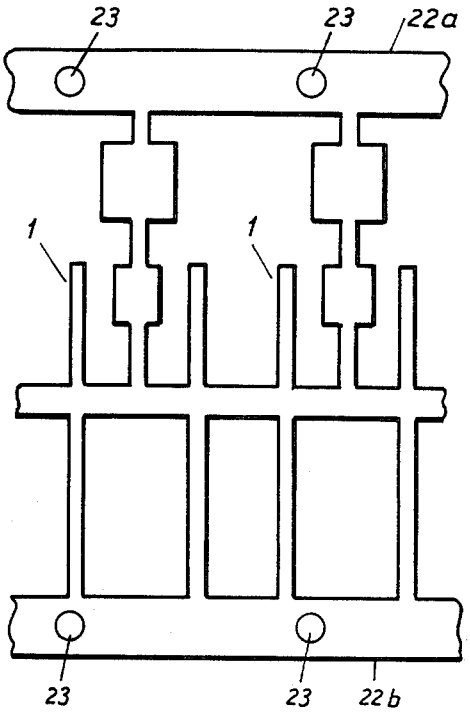

The manufacturing of the lead frame according to FIG. 1 is suitably carried out so that the frame is punched as an "end-less band" according to FIG. 4 in such a manner that the leads 2*a*,2*b*,4 and the plates 5 and 7 as well as the connecting part 6 are kept together by means of carrying bands 22*a*,22*b* provided with guiding holes 23. The frames 1 are cut, after the plastics embedding from the carrying band 22*a*,22*b*. This implies a rational manufacturing of the lead as well as of the rear electrode of an electret microphone for manufacture on a large scale.

What we claim is:

1. In an electret microphone comprising an electret, a rear electrode and an amplifying unit including a signal input, a lead frame including signal output terminals for the microphone and for conductively connecting the electret to the signal input of said amplifying unit, said frame including a first plate (5) for supporting said amplifying unit, a second plate (7), conductive means (6) for conductively connecting said first plate to said second plate (7), said second plate constituting said rear electrode in the microphone, a pair of ribbon-like leads (2*a*, 2*b*) constituting said output terminals, and means (9, 21*a*, 21*b*) for conductively connecting said leads (2*a*, 2*b*) to said amplifying unit.

2. A lead frame according to claim 1 comprising connecting means and a further lead and wherein said pair of ribbon-like leads (2*a*, 2*b*) are arranged in parallel and are connected by said connecting means (3*a*, 3*b*), said first plate (5) being connected with said pair of first leads by said further lead (4).

3. A lead frame according to claim 2, wherein said conductive means is a lead (6) of the same shape as said further lead (4).

4. A lead frame according to claim 2 wherein, said pair of ribbon-like leads (2*a*) are kept together through said connecting means which form a connecting area.

5. A lead frame according to claim 4, wherein at least one lead in said pair of ribbon-like leads (2*a*–2*b*) is extended beyond said connecting area (3*a*–3*b*) and is terminated adjacent the first plate (5) to provide a contact surface, said frame further including means providing a conducting connection between the said one lead and the amplifying unit.

6. A lead frame according to claim 1, wherein said second plate (7) is of substantially rectangular shape and is provided with apertures (7*a*).

7. A lead frame for an electret microphone comprising an H-shaped structure of thin metallic material including spaced parallel legs and a crossbar therebetween, a first plate spaced from said crossbar and located between said legs, a lead connecting said first plate to said crossbar, a second plate spaced from said first plate, and a lead connecting said plates.

8. A lead frame as claimed in claim 7 wherein said plates and leads are coplanar with said H-shaped structure.

9. A lead frame as claimed in claim 8 wherein said second plate is provided with holes.

10. A lead frame as claimed in claim 9 comprising an amplifier chip mounted on said first plate and leads connecting said chip with said legs.

11. Apparatus comprising a lead frame as claimed in claim 10 and further comprising a first case half supporting said plates, bars (12*a*, 12*b*) adjacent said second plate, and a metallized film supported on said bars in spaced parallel relation to said second plate.

12. Apparatus as claimed in claim 11 comprising a second case half opposite said first half and provided with openings aligned with said plates, and cover means encircling the opposed halves collectively.

* * * * *